United States Patent [19]

Nagahori et al.

[11] Patent Number: 4,757,483

[45] Date of Patent: Jul. 12, 1988

[54] ANALOG CLOCK

[75] Inventors: Yukihiro Nagahori, Saitama; Hikoshi Izumi, Hanyu, both of Japan

[73] Assignee: Jeco Company Limited, Saitama, Japan

[21] Appl. No.: 122,573

[22] Filed: Nov. 16, 1987

Related U.S. Application Data

[63] Continuation of Ser. No. 888,036, Jul. 18, 1986, abandoned.

[30] Foreign Application Priority Data

Jul. 24, 1985 [JP] Japan ..... 60-113173[U]

[51] Int. Cl.[4] ..... G04B 19/04; G04F 5/00

[52] U.S. Cl. ..... 368/80; 368/157; 368/187

[58] Field of Search ..... 368/76, 80, 185–188, 368/155–157, 160

[56] References Cited

U.S. PATENT DOCUMENTS

| | | | |
|---|---|---|---|
| 4,086,755 | 5/1978 | Ueda | 368/187 |
| 4,095,406 | 6/1978 | Kikuchi et al. | 368/187 |
| 4,150,536 | 4/1979 | Nakajima et al. | 368/155 |
| 4,357,693 | 11/1982 | Plancon et al. | 368/187 |
| 4,445,785 | 5/1984 | Chambon et al. | 368/157 |
| 4,514,676 | 4/1985 | Grandjean et al. | 368/157 X |

FOREIGN PATENT DOCUMENTS

| | | |
|---|---|---|
| A10048217 | 3/1982 | European Pat. Off. . |
| A2001187 | 1/1979 | United Kingdom . |
| A2007409 | 5/1979 | United Kingdom . |
| 1554899 | 10/1979 | United Kingdom . |
| 1591233 | 6/1981 | United Kingdom . |

*Primary Examiner*—Vit W. Miska

*Attorney, Agent, or Firm*—Ladas & Parry

[57] ABSTRACT

An analog clock comprises an oscillator circuit for producing a signal having a predetermined frequency, a circuit for frequency-dividing the output signal of the oscillator circuit so as to produce a clock pulse signal and adjustment pulse signals having a period different from that of the clock pulse signal, a manipulation part for producing an adjustment instruction signal responsive to a time adjustment made in the manipulation part, a circuit for producing a driving pulse signal from one of the clock pulse signal and the adjustment pulse signals depending on the adjustment instruction signal and for supplying the driving pulse signal to a coil for forward rotation or to a coil for reverse rotation, and a stepping motor having a rotor which is rotated in the forward (or reverse) direction by a predetermined angle responsive to an excitation of the coil for forward (or reverse) rotation by one pulse of the driving pulse signal. Hands of the analog clock are rotated by the rotation of the rotor.

5 Claims, 3 Drawing Sheets

ANALOG CLOCK

This is a continuation of co-pending application Ser. No. 888,036 filed on July 18, 1986, now abandoned.

BACKGROUND OF THE INVENTION

The present invention generally relates to analog clocks, and more particularly to an analog clock in which hands (pointers) thereof are rotationally driven by a stepping motor.

A conventional analog clock is provided with an adjusting shaft, and the time is adjusted by rotating this adjusting shaft. But when this analog clock is used as a built-in clock of an automobile, there is a problem from the point of view of the design in that the adjusting shaft must project from a clockface through a hole in a front glass of the clock. On the other hand, when the analog clock is arranged within an instrument panel together with a speedometer and the like, it is necessary to provide a hole in a glass which covers the instrument panel so that the adjusting shaft can project from the clockface through this hole.

For this reason, there conventionally are analog clocks which can be adjusted by remote control. Such remote controlled analog clocks may be divided into first and second types. The analog clock of the first type employs two motors, that is, a clock motor for driving the clock and an adjusting motor for driving the adjusting shaft. The analog clock of the second type employs a single stepping motor for driving the clock, and when adjusting the time, this stepping motor is rotated in a forward or reverse direction at a speed which is high compared to that when the stepping motor is rotated to keep the time.

The analog clock of the first type requires the adjusting motor for driving the adjusting shaft, gears for transmitting the rotation of the adjusting motor to the adjusting shaft, a clutch mechanism for meshing a gear of the adjusting shaft with a gear of a minute hand shaft and the like. Hence, there is a problem in that the analog clock of the first type is complex and expensive.

On the other hand, the analog clock of the second type supplies to a coil a pulse signal for forward rotation having a narrow pulse width so as to slightly urge a rotor in the forward direction, and rotates the rotor in the reverse direction by supplying to the coil a pulse signal for reverse rotation having a sufficiently wide pulse width with a timing with which the rotor reacts to the urging force and moves in the reverse direction. For this reason, when the size or the like of the stepping motor is changed, it is necessary to produce a pulse signal for reverse rotation having a timing peculiar to that stepping motor when rotating the rotor in the reverse direction. Thus, the size or the like of the analog clock cannot be changed arbitrarily without changing the timing of the pulse signal for reverse rotation, and the design of the analog clock cannot be changed with ease. Furthermore, there is a problem in that the analog clock of the second type may perform an erroneous operation such as missing a step movement and performing a step movement in a wrong direction when subjected to external vibration, shock and the like.

SUMMARY OF THE INVENTION

Accordingly, it is a general object of the present invention to provide a novel and useful analog clock in which the problems described heretofore are eliminated.

Another and more specific object of the present invention is to provide an analog clock comprising an oscillator circuit for producing a signal having a predetermined frequency, a frequency dividing circuit for frequency-dividing the output signal of the oscillator circuit so as to produce a clock pulse signal and adjustment pulse signals having a period different from that of the clock pulse signal, an adjusting manipulation part for producing an adjustment instruction signal responsive to a time adjustment made by manipulating the adjusting manipulation part, a controlling and driving circuit for producing a driving pulse signal from one of the clock pulse signal and the adjustment pulse signals depending on the adjustment instruction signal and for supplying the driving pulse signal to a coil for forward rotation or to a coil for reverse rotation, and a stepping motor having a rotor which is rotated in the forward direction by a predetermined angle responsive to an excitation of the coil for forward rotation by one pulse of the driving pulse signal and is rotated in the reverse direction by a predetermined angle responsive to an excitation of the coil for reverse rotation by one pulse of the driving pulse signal. Hands of the analog clock are rotated by the rotation of the rotor. According to the analog clock of the present invention, it is possible to rotate the hands in both the forward and reverse directions by use of the single stepping motor. In addition, the analog clock requires only a small number of parts and is inexpensive, and the construction is simple. It is unnecessary to change the timing of the driving pulse signal even when the size or the like of the analog clock is changed, and the design of the analog clock can be changed with ease. Furthermore, it is possible to prevent the analog clock from performing an erroneous operation due to external vibration, shock and the like.

Still another object of the present invention is to provide an analog clock in which the clock pulse signal has 1/30 pulse per second (pps) and the adjustment pulse signals respectively have 4 pps and 8 pps. According to the analog clock of the present invention, it is possible to set two kinds of rotating speeds of the hands.

A further object of the present invention is to provide an analog clock in which the adjusting manipulation part comprises a forward rotation instruction switch, a reverse rotation instruction switch, a high speed instruction switch and a low speed instruction switch, and produces the adjustment instruction signal responsive to the manipulation of these switches. According to the analog clock of the present invention, it is possible to arbitrarily set the forward and reverse rotations of the hands and the rotational speed of the hands.

Another object of the present invention is to provide an analog clock in which the controlling and driving circuit comprises polarity inverting means for producing a driving pulse signal which is always an alternate repetition of positive and negative polarity pulses. According to the analog clock of the present invention, it is possible to positively rotate the rotor of the stepping motor in the forward or reverse direction by a predetermined angle for one pulse of the driving pulse signal.

Still another object of the present invention is to provide an analog clock in which the controlling and driving circuit comprises signal selecting means for selectively obtaining the adjustment pulse signal having 8 pps responsive to an adjustment instruction signal produced from the high speed instruction switch and for selectively obtaining the adjustment pulse signal having 4 pps responsive to an adjustment instruction signal produced from the low speed instruction switch, and the driving pulse signal is produced from the adjustment pulse signal that is selectively obtained. According to the analog clock of the present invention, it is possible to produce the driving pulse signal by a circuit having a simple circuit construction.

Other objects and further features of the present invention will be apparent from the following detailed description when read in conjunction with the accompanying drawings.

DETAILED DESCRIPTION

Figure 1:
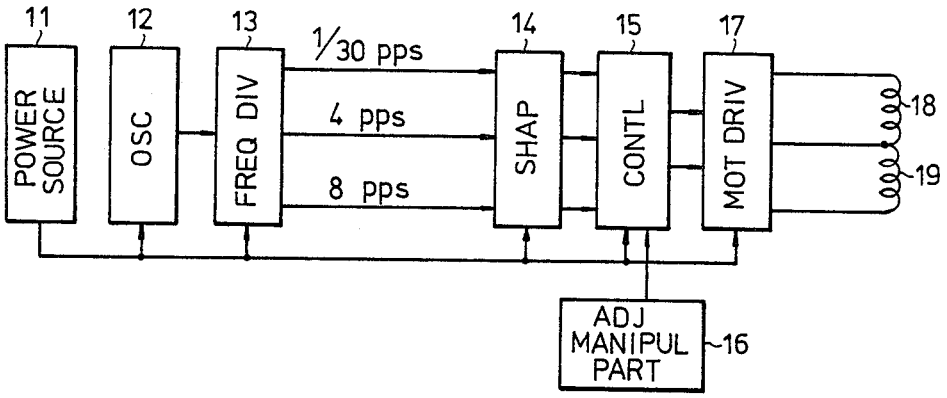
FIG. 1 is a system block diagram showing an embodiment of a circuit part of the analog clock according to the present invention.

FIG. 1 shows the block system of an embodiment of the circuit part of the analog clock according to the present invention. In FIG. 1, a power source circuit 11 converts a voltage supplied from a battery of an automobile, for example, into a predetermined voltage. The predetermined voltage from the power source circuit 11 is supplied to an oscillator circuit 12, a frequency dividing circuit 13 and the like which are provided in the subsequent stages. The oscillator circuit 12 is supplied with the predetermined voltage from the power source circuit 11 and undergoes a stable oscillation to produce a signal having a predetermined frequency. The output signal of the oscillator circuit 12 is supplied to the frequency dividing circuit 13. The frequency dividing circuit 13 frequency-divides the output signal of the oscillator circuit 12 and produces three pulse signals respectively having 1/30 pulse per second (pps), 4 pps and 8 pps, for example. The output pulse signals of the oscillator circuit 12 are supplied to a shaping circuit 14 which shapes the pulse signals so that the pulse width thereof becomes 80 msec, for example. Output pulse signals of the shaping circuit 14 are supplied to a control circuit 15. The pulse signal having 1/30 pps is used as a clock pulse signal, and the pulse signals having 4 pps and 8 pps are respectively used as an adjustment pulse signal.

An adjusting manipulation part 16 is provided with a forward rotation instruction switch, a reverse rotation instruction switch, a high speed instruction switch and a low speed instruction switch, for example. An adjustment instruction signal generated from one of the switches of the adjusting manipulation part 16 is supplied to the control circuit 15. When no adjustment instruction signal is supplied to the control circuit 15 from the adjusting manipulation part 16, the control circuit 15 selectively obtains the pulse signal having 1/30 pps and produces from this pulse signal a driving pulse signal which is an alternate repetition of positive and negative polarity pulses and produces a control signal which instructs a forward rotation. The driving pulse signal and the control signal from the control circuit 15 are supplied to a motor driving circuit 17. When an adjustment instruction signal instructing the forward rotation (or reverse rotation) is supplied to the control circuit 15 from the adjusting manipulation part 16, the control circuit 15 produces a control signal which instructs the forward rotation (or reverse rotation) and supplies this control signal to the motor driving circuit 17. In addition, when an adjustment instruction signal instructing the high speed rotation (or low speed rotation) is supplied to the control circuit 15 from the adjusting manipulation part 16, the control circuit 15 selectively obtains the pulse signal having 8 pps (or 4 pps) and produces from this pulse signal a driving pulse signal which is an alternate repetition of positive and negative polarity pulses.

The control circuit 15 is designed so that when the pulse signal to be selectively obtained is switched among the pulse signals having 1/30 pps, 4 pps and 8 pps and when the rotation is switched between the forward and reverse rotations, the polarity of the driving pulse signal is always inverted before and after such switching. If the polarity of the driving pulse signal were the same before and after the switching, a rotor of a stepping motor (not shown) will not rotate responsive to a first pulse of the driving pulse signal after the switching.

The motor driving circuit 17 amplifies the driving pulse signal from the control circuit 15. When the control signal from the control circuit 15 instructs the reverse rotation, the motor driving circuit 17 supplies the driving pulse signal to a coil 18 for reverse rotation of the stepping motor. On the other hand, when the control signal from the control circuit 15 instructs the forward rotation, the motor driving circuit 17 supplies the driving pulse signal to a coil 19 for forward rotation of the stepping motor.

Figure 2:
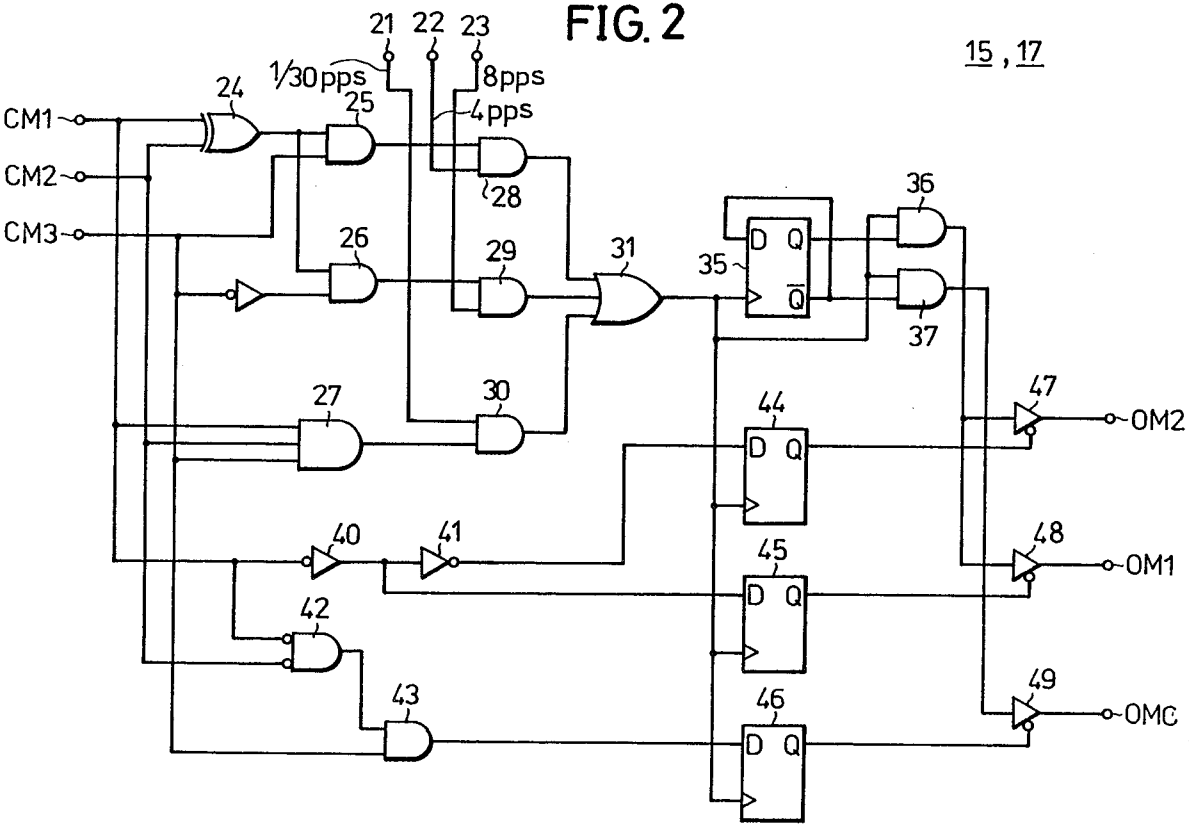
FIG. 2 is a circuit diagram showing an embodiment of a control circuit and a motor driving circuit in the block system shown in FIG. 1.

FIG. 2 shows the circuit diagram of an embodiment of the control circuit 15 and the motor driving circuit 17. In FIG. 2, the bits of a 3-bit adjustment instruction signal from the adjusting manipulation part 16 are applied to respective terminals CM1, CM2 and CM3. All of the three bits of the adjustment instruction signal have a high level when the analog clock is performing a normal clock operation. The time adjustment with the low speed rotation in the forward direction is instructed when the level at only the terminal CM2 is low. The time adjustment with the high speed rotation in the forward direction is instructed when the levels at only the terminals CM2 and CM3 are low. The time adjustment with the low speed rotation in the reverse direction is instructed when the level at only the terminal CM1 is low. Furthermore, the time adjustment with the high speed rotation in the reverse direction is instructed when the levels at only the terminals CM1 and CM3 are low. The levels at all of the terminals CM1, CM2 and CM3 are low when the operation of the analog clock is to be stopped.

The pulse signals having 1/30 pps, 4 pps and 8 pps from the frequency dividing circuit 13 are applied to respective terminals 21, 22 and 23. An output signal level of an exclusive-OR circuit 24 becomes high when the levels at the terminals CM1 and CM2 mutually differ. An output signal level of an AND circuit 25 is high when the low speed rotation is instructed, and an output signal level of an AND circuit 26 is high when the high speed rotation is instructed. An output signal level of an AND circuit 27 is high during the normal clock operation. Accordingly, an AND circuit 28 produces the pulse signal having 4 pps only when the low speed rotation is instructed, and an AND circuit 29 produces the pulse signal having 8 pps only when the high speed rotation is instructed. An AND circuit 30 produces the pulse signal having 1/30 pps only during the normal clock operation. Output pulse signals of the AND circuits 28 through 30 are passed through an OR circuit 31 and is supplied to a circuit of a subsequent stage. The exclusive-OR circuit 24, the AND circuits 25 through 30 and the OR circuit 31 constitute signal selecting means.

An output pulse signal of the OR circuit 31 is supplied to a clock input terminal of a flip-flop 35. A $\overline{Q}$-output terminal of the flip-flop 35 is coupled to a data input terminal D thereof to constitute a trigger type flip-flop. The internal state of the flip-flop 35 is inverted every time one pulse of the pulse signal is supplied to the clock input terminal thereof. An AND circuit 36 is supplied with the output pulse signal of the OR circuit 31 and a signal from a Q-output terminal of the flip-flop 35. An AND circuit 37 is supplied with the output pulse signal of the OR circuit 31 and a signal from the $\overline{Q}$-output terminal of the flip-flop 35. The AND circuits 36 and 37 alternately pass the output pulse signal of the OR circuit 31 for every period of the output pulse signal of the OR circuit 31. The output pulse signal of the AND circuit 36 is supplied to tri-state buffers 47 and 48, and the output pulse signal of the AND circuit 37 is supplied to a tri-state buffer 49. The flip-flop 35 and the AND circuits 36 and 37 constitute polarity inverting means.

The bit of the adjustment instruction signal applied to the terminal CM1 is supplied to a data input terminal D of a flip-flop 44 via inverters 40 and 41. The bit applied to the terminal CM1 is also supplied to a data input terminal D of a flip-flop 45 via the inverter 40. In other words, the input data level of the flip-flop 44 becomes high only when the forward rotation is instructed, and the input data level of the flip-flop 45 becomes high only when the reverse rotation is instructed. The bits applied to the terminals CM1 and CM2 are supplied to an AND circuit 42, and the bit applied to the terminal CM3 and an output signal of the AND circuit 42 are supplied to an AND circuit 43. Hence, the AND circuit 43 produces a high-level signal and supplies this high-level signal to a data input terminal D of a flip-flop 46 only when the levels at the terminals CM1 and CM2 are low and the operation of the analog clock is to be stopped.

The input data of the flip-flops 44 through 46 are latched responsive to the output pulse signal of the OR circuit 31 applied to the clock input terminals thereof. Signals produced from Q-output terminals of the flip-flops 44 through 46 are supplied to control terminals of the tri-state buffers 47, 48 and 49, respectively. The tri-state buffers 47 through 49 have a high impedance when the signal level at the control terminal thereof is high. The tri-state buffers 47, 48 and 49 supply the signal supplied thereto to respective terminals OM2, OM1 and OMC when the signal level at the control terminal thereof is low. One end of the coil 18 for reverse rotation is coupled to the terminal OM2, and one end of the coil 19 for forward rotation is coupled to the terminal OM1. The other ends of the coils 18 and 19 are commonly coupled to the terminal OMC.

Accordingly, when the forward rotation is instructed, the positive and negative polarity pulses of the driving pulse signals produced from the AND circuits 36 and 37 are alternately supplied to the coil 19 via the respective tri-state buffers 48 and 49. On the other hand, when the reverse rotation is instructed, the positive and negative polarity pulses of the driving pulse signals produced from the AND circuits 36 and 37 are alternately supplied to the coil 18 via the respective tri-state buffers 47 and 49. The inverters 40 and 41, the AND circuits 42 and 43, the flip-flops 44 through 46 and the tri-state buffers 47 through 49 constitute selective output means.

Figure 3A:
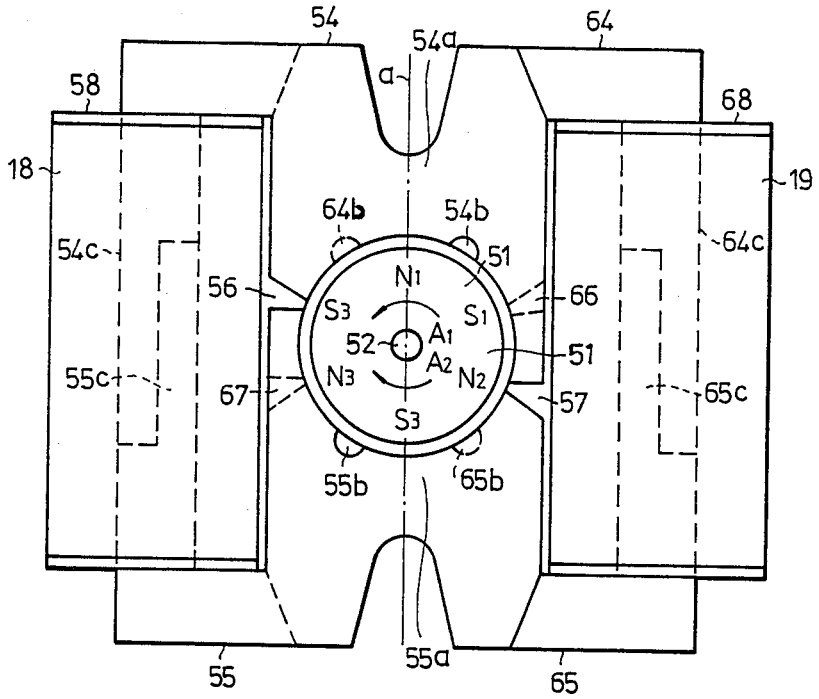
FIGS. 3A and 3B are a plan view and a front view respectively showing an embodiment of a stepping motor employed in the analog clock according to the present invention.
Figure 3B:
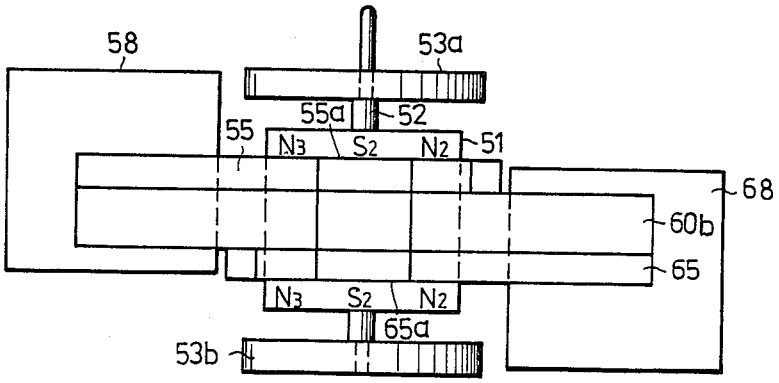

FIGS. 3A and 3B are the plan view and the front view respectively showing an embodiment of the stepping motor employed in the analog clock according to the present invention. A rotor 51 comprises a cylindrical magnetic member sequentially having magnetic poles N1, S1, N2, S2, N3 and S3 on an outer peripheral surface thereof at equi-angular intervals (60°). The rotor 51 is fixed to a rotor shaft 52 and is rotatably supported by receiving plates 53*a* and 53*b*. Stators 54 and 55 for reverse rotation form a closed magnetic path via the rotor 51, and stator magnetic pole parts 54*a* and 55*a* of the stators 54 and 55 respectively have a semi-circular cutout portion separated from and confronting the outer peripheral surface of the rotor 51. Openings 56 and 57 are formed on magnetic pole ends of the respective the stator magnetic pole parts 54*a* and 55*a*. The openings 56 and 57 are formed asymmetrically to a center line a on the magnetic pole ends of the stator magnetic pole parts 54*a* and 55*a* but the openings 56 and 57 open symmetrically to the rotor shaft 52. Notch parts 54*b* and 55*b* which determine the stationary position of the rotor 51 are formed at inner parts of the cutout portions of the stator magnetic pole parts 54*a* and 55*a* at positions rotated 30° from the center line a about the rotor shaft 52. In FIG. 3A, the rotor 51 is stationary in a state where the notch part 54*b* is positioned between the magnetic poles N1 and S1 and the notch part 55*b* is positioned between the magnetic poles S2 and N3. Base parts 54*c* and 55*c* of the stators 54 and 55 are in contact with each other within a bobbin 58 of the coil 18.

Stators 64 and 65 for forward rotation have the same construction as the stators 54 and 55, and are arranged in a state that would be obtained by turning over the stators 54 and 55 about the center line a. The stators 64 and 65 have stator magnetic pole parts (only 65*a* shown), and notch parts 64*b* and 65*b* are formed on cutout portions of the respective stator magnetic pole parts of the stators 64 and 65. The stators 64 and 65 respectively have base parts 64*c* and 65*c* and openings 66 and 67. The coil 19 has a bobbin 68. The stators 54 and 55 and the stators 64 and 65 are separated from each other and held in place with non-magnetic plates (only 60*b* shown) interposed therebetween. The stator magnetic pole parts 54*a* and 55*a* confront each other at the upper part of the rotor 51 in FIG. 3B, and the stator magnetic pole parts 64*a* and 65*a* confront each other at the lower part of the rotor 51 in FIG. 3B.

When the positive polarity driving pulse of the driving pulse signal is supplied to the coil 18 in the state shown in FIG. 3A, the stators 54 and 55 are respectively excited to the south (S) and north (N) poles. Hence, the magnetic poles S3 and N2 respectively become attracted toward the openings 56 and 57, and the rotor 51 rotates in a direction A1 (that is, in the reverse direction or counterclockwise) by 60° and stops. When the stators 54 and 55 are respectively excited to the north and south poles by the next negative polarity driving pulse of the driving pulse signal, the magnetic poles N1 and S2 respectively become attracted toward the openings 56 and 57, and the rotor 51 rotates in the direction A1 by 60° and stops. Thus, the rotor 51 rotates in the direction A1 in steps of 60° for every one pulse of the driving pulse signal.

On the other hand, when the positive polarity driving pulse of the driving pulse signal is supplied to the coil 19 in the state shown in FIG. 3A, the stators 64 and 65 are respectively excited to the south and north poles. Hence, the magnetic poles S1 and N3 respectively become attracted toward the openings 66 and 67, and the rotor 51 rotates in a direction A2 (that is, forward direction or clockwise) by 60° and stops. When the stators 64 and 65 are respectively excited to the north and south poles by the next negative polarity driving pulse of the driving pulse signal, the rotor 51 similarly rotates in the direction A2 by 60° and stops. Therefore, the rotor 51 rotates in the direction A2 in steps of 60° for every one pulse of the driving pulse signal.

Figure 4:
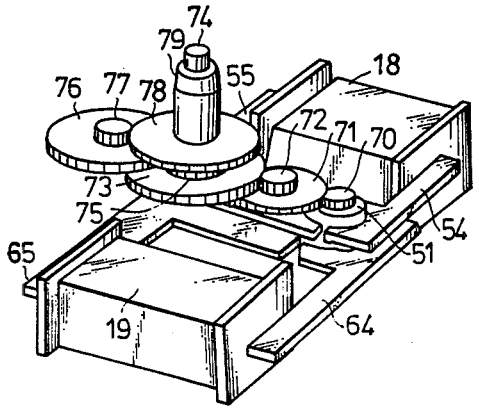
FIG. 4 is a perspective view showing an embodiment of the stepping motor and a gear part of the analog clock according to the present invention.

FIG. 4 is a perspective view showing an embodiment of the stepping motor and a gear part of the analog clock according to the present invention. As shown in FIG. 4, the rotation of the rotor 51 is transmitted to an idler gear 72 via gears 70 and 71, and a gear 73 in mesh with the idler gear 72 is rotated. The rotational speed of the gear 73 is 1/20 the rotational speed of the rotor 51. A rotary shaft 74 of the gear 73 is used as a minute hand shaft. The rotation of the gear 73 is transmitted from a gear 75 which has the minute hand shaft 74 as a rotary shaft thereof to an hour hand gear 78 via gears 76 and 77, so as to rotate an hour hand pipe 79. The analog clock shown in FIG. 4 is a two-hand analog clock having the minute hand and the hour hand.

As described heretofore, the analog clock according to the present invention employs the stepping motor having the stators 54 and 55 for reverse rotation and the stators 64 and 65 for forward rotation with respect to the single rotor 51. Hence, it is possible to produce the driving pulse signal by use of a simple circuit, and it is unnecessary to change the timing of the driving pulse signal even when the size or the like of the stepping motor is changed according to the design of the analog clock. In addition, it is possible to prevent the analog clock from performing an erroneous operation such as missing a step movement and performing a step movement in a wrong direction due to external vibration, shock and the like. Moreover, the analog clock according to the present invention requires only a small number of parts including a single stepping motor and is inexpensive, and the construction is simple.

Further, the present invention is not limited to these embodiments, but various variations and modifications may be made without departing from the scope of the present invention.

What is claimed is:

1. An analog clock comprising:

at least a minute hand and an hour hand;

an oscillator circuit for producing a signal having a predetermined frequency;

a frequency dividing circuit for frequency-dividing the output signal of said oscillator circuit so as to produce a clock pulse signal and adjustment pulse signals having a period different from that of the clock pulse signal;

an adjusting manipulation part for producing an adjustment instruction signal responsive to a time adjustment made by manipulating said adjusting manipulation part, said adjustment instruction signal assuming one of different values depending on forward and reverse rotation instructions;

signal selecting means for selectively passing one of the clock pulse signal and the adjustment pulse signals depending on the adjustment instruction signal;

driving signal producing means supplied with an output of said signal selecting means for producing two driving pulse signals which have opposite polarities, said driving signal producing means comprising a flip-flop having a clock input terminal supplied with the output of said signal selecting means, a Q-output terminal coupled to one input terminal of a first AND circuit, and a $\overline{Q}$-output terminal which is coupled to one input terminal of a second AND circuit and to a data input terminal of the flip-flop, the other terminals of the first and second AND circuits being supplied with the output of said signal selecting means, said first and second AND circuit producing said two driving pulse signals as outputs thereof;

a stepping motor having a rotor, forward rotation means for rotating said rotor in a forward direction and reverse rotation means for rotating said rotor in a reverse direction, said rotor rotating the hands of the analog clock; and output means for supplying said two driving pulse signals to one of said forward rotation means and said reverse rotation means depending on the values of said adjustment instruction signal, said output means comprising first and second tri-state buffers which are supplied with the output of said first AND circuit, a third tri-state buffer which is supplied with the output of said second AND circuit, first output control means for controlling the first buffer to produce an output during the reverse rotation instruction is made, second output control means for controlling the second buffer to produce an output during the forward rotation instruction is made, third output control means for controlling the third buffer to produce an output during either of the forward and reverse rotation instructions is made, said forward rotation means being coupled to output terminals of the second and third buffers, said reverse rotation means being coupled to output terminals of the first and third buffers, said forward rotation means comprising first stator means and first coil means, said first stator means driving said rotor in the forward direction so that said rotor rotates by a first predetermined angle when one pulse of the driving pulse signal is supplied to said first coil means, said reverse rotation means comprising a second stator means and second coil means, said second stator means driving said rotor in the reverse direction so that said rotor rotates by a second predetermined angle when one pulse of the driving pulse signal is supplied to said second coil means.

2. An analog clock as claimed in claim 1 in which said clock pulse signal has 1/30 pulse per second and said adjustment pulse signals respectively have four pulses per second and eight pulses per second.

3. An analog clock as claimed in claim 2 in which said adjusting manipulation part comprises a forward rotation instruction switch, a reverse rotation instruction switch, a high speed instruction switch and a low speed instruction switch, said adjusting manipulation part producing the adjustment instruction signal responsive to the manipulation of said switches.

4. An analog clock as claimed in claim 3 in which said signal selecting means selectively passes the adjustment pulse signal having eight pulses per second responsive to an adjustment instruction signal produced from said high speed instruction switch and selectively passes the adjustment pulse signal having four pulses per second responsive to an adjustment instruction signal produced from said low speed instruction switch, said two driving pulse signals being produced from the adjustment pulse signal that is selectively passed in said signal selecting means.

5. An analog clock as claimed in claim 1 in which said stepping motor rotates said rotor thereof in steps of 60° for every one pulse of said driving pulse signal.

* * * * *